US011318598B2

(12) United States Patent
Rampling

(10) Patent No.: US 11,318,598 B2
(45) Date of Patent: May 3, 2022

(54) POLE ATTACHMENT FOR A SKIMMING TOOL AND SKIMMING TOOL SYSTEM COMPRISING THE SAME

(71) Applicant: Scott Cutters UK Limited, Beaconsfield (GB)

(72) Inventor: Scott Rampling, Beaconsfield (GB)

(73) Assignee: Scott Cutters UK Limited, Beaconsfield (GB)

( * ) Notice: Subject to any disclaimer, the term of this patent is extended or adjusted under 35 U.S.C. 154(b) by 0 days.

(21) Appl. No.: 16/618,683

(22) PCT Filed: May 25, 2018

(86) PCT No.: PCT/GB2018/051427
§ 371 (c)(1),
(2) Date: Dec. 2, 2019

(87) PCT Pub. No.: WO2018/220350
PCT Pub. Date: Dec. 6, 2018

(65) Prior Publication Data

US 2020/0122314 A1 Apr. 23, 2020

(30) Foreign Application Priority Data

May 30, 2017 (GB) ..... 1708608

(51) Int. Cl.
*B25G 3/24* (2006.01)
*E04F 21/16* (2006.01)

(52) U.S. Cl.
CPC ..... *B25G 3/24* (2013.01); *E04F 21/161* (2013.01)

(58) Field of Classification Search
CPC ..... B25G 3/24; E04F 21/16; E04F 21/161
USPC ..... 15/145
See application file for complete search history.

(56) References Cited

U.S. PATENT DOCUMENTS 3,029,454 A 4/1962 Short et al.
4,407,039 A * 10/1983 Moss ..... A47L 13/24 15/144.2
5,319,822 A * 6/1994 Shaw ..... A46B 7/04 15/145

(Continued)

FOREIGN PATENT DOCUMENTS

DE 2030202376 U 4/2003
FR 405949 A * 1/1910 ..... B25G 3/24
GB 119424 A 10/1918

OTHER PUBLICATIONS

International Search Report for PCT/GB2018/051427 dated Aug. 30, 2018.

(Continued)

*Primary Examiner* — Eric A. Gates
(74) *Attorney, Agent, or Firm* — Gearhart Law, LLC; David Postolski, Esq.

(57) ABSTRACT

Pole attachment for a skimming tool and a skimming tool system comprising the same A pole attachment for a skimming tool, comprising a clamp, which comprises a pair of jaws (102) for gripping the skimming tool and a clamping mechanism for applying a clamping force to the jaws (102), wherein the clamping mechanism comprises a pair of wings (106), which extend out beyond opposed transverse edges of the jaws (102) in a width direction of the jaws (102).

10 Claims, 8 Drawing Sheets

(56) References Cited

U.S. PATENT DOCUMENTS

| | | | | |
|---|---|---|---|---|
| 5,901,402 | A * | 5/1999 | Williams | B25G 3/04 15/144.1 |
| 6,115,921 | A | 9/2000 | Garneau | |
| 6,931,690 | B2 * | 8/2005 | Cox | A47L 1/06 15/144.1 |
| 7,870,634 | B2 * | 1/2011 | Warning | B25G 3/06 15/229.8 |
| 9,234,358 | B2 * | 1/2016 | Harper | E04F 21/162 |
| 2006/0260084 | A1 * | 11/2006 | Guizzi | A47L 1/06 15/245 |
| 2009/0025169 | A1 | 1/2009 | Warning et al. | |

OTHER PUBLICATIONS

Written Opinion for PCT/GB2018/051427 dated Aug. 30, 2018.
Notification of Transmittal of the International Search and Written Opinion PCT/GB2018/051427 dated Aug. 30, 2018.
GB Search Report for GB1708608.3, dated Nov. 15, 2017.

* cited by examiner

POLE ATTACHMENT FOR A SKIMMING TOOL AND SKIMMING TOOL SYSTEM COMPRISING THE SAME

This application is a PCT National Phase application based on PCT Application No. PCT/GB2018/051427, filed on May 25, 2018, which claims priority to GB 1708638.3, filed on May 30, 2017 which is incorporated herein by reference in its entirety.

The present disclosure relates to a pole attachment suitable for use with a skimming tool for smoothing and levelling wet finish coat plaster applied to a surface such as a wall or ceiling, and to a smoothing tool system comprising the pole attachment and a skimming tool.

Conventionally, plaster has been applied to walls and ceilings using a plaster trowel which comprises a flat rectangular stainless steel sheet having dimensions of about 280 mm to 460 mm by 120 mm with a generally cylindrical handle mounted spaced from and parallel to the sheet. The same tool is used for smoothing and levelling the plaster once it has been applied.

A known plaster "ruling off" levelling tool, known as a 'Darby', comprises an extruded aluminium elongate body which may be hollow or solid. The known tool sometimes has a pair of spaced handles extending perpendicularly there from. The spacing of the handles is adjustable in some cases. However, the 'Darby' tool, being generally rigid and inflexible, is only useful for "ruling off" and levelling backing plaster (first coat plaster) or scratch coat sand and cement render (first coat render).

Recently, a new long tool for skimming, smoothing and levelling finish coat plaster (final coat plaster) has been developed, which is capable of reducing finish plastering times by approximately 75%. Such a tool, which is detailed in EP 2 726 685, comprises an elongate generally rectangular, flat, flexible, elastomeric web and an elongate, substantially rigid handle connected to and extending along substantially the length of one long edge of the web, wherein the handle is adapted to be gripped by the user at any point along its length. The new tool makes it possible for a single operative to tackle larger areas within short drying times/conditions due to the advantage of the increase speed. In addition another advantage of the tool is that levelling off of finish plaster on uneven substrates becomes possible giving an improved finish over substantially shorter and inflexible conventional stainless steel sheet trowels. The advantages of the tool are further increased by the attachment of a pole, which allows an operative to skim, smooth and level surfaces that are otherwise out of reach, such as ceilings.

The present invention arose in a bid to provide a suitable pole attachment for removably attaching an extension (or extendable) pole.

According to the present invention in a first aspect, there is provided a pole attachment for a skimming tool, comprising a clamp, which comprises a pair of jaws for gripping the skimming tool and a clamping mechanism for applying a clamping force to the jaws, wherein the clamping mechanism comprises a pair of wings, which extend out beyond opposed transverse edges of the jaws in a width direction of the jaws.

By virtue of the wings it is possible to provide a pole attachment that is easy to attach to a skimming tool, by virtue of relatively narrow jaws, whilst providing excellent lateral support either side of the pole along the length of the skimming tool.

Further, preferred, features are presented in the dependent claims.

According to the present invention according to a further aspect, there is provided a skimming tool system comprising a pole attachment as defined above and a skimming tool.

Embodiments of the inventions are described below with reference to the accompanying drawings, in which.

Figure 1:
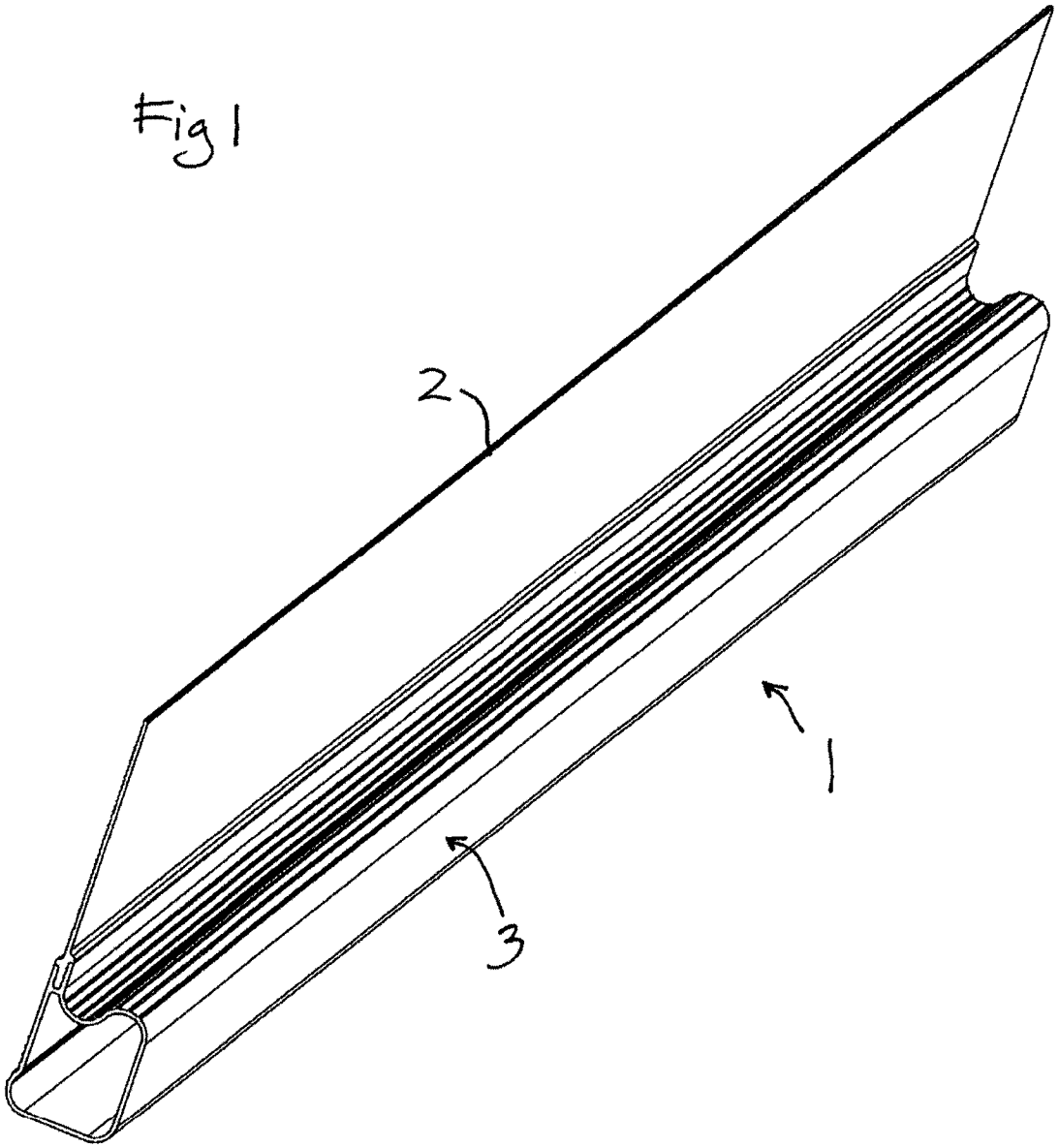
FIG. 1 shows a perspective view of a skimming tool forming part of a skimming tool system according to the present invention.
Figure 1:
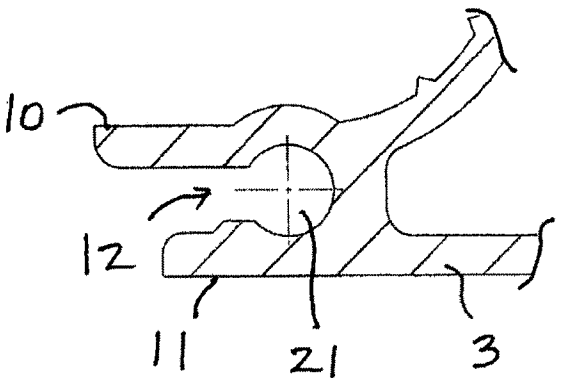

The present invention relates to a pole attachment and to a skimming tool system comprising the pole attachment and a skimming tool. In the exemplary embodiments that follow, the pole attachment is configured for attachment to a particularly preferred skimming tool and the system comprises such a skimming tool. It should be appreciated, however, that the present invention is not to be limited as such. It is to be noted that the pole attachment may be adapted to suit various other forms of skimming tool, in particular by modifying the jaw profiles.

Consideration is first given to an exemplary form of skimming tool:

FIGS. 1 to 5 show a long skimming tool 1 for smoothing and levelling finish coat plaster applied to a surface such as a wall or a ceiling. The tool comprises a plaster engaging blade in the form of an elongate, generally rectangular, flat, flexible, elastomeric web 2 which is joined to a substantially rigid, elongate handle 3 which extends along substantially the entire length of one long edge of the web. The handle 3 has a cross-sectional profile which is substantially constant along its length and is thereby adapted to be gripped by the user at any point along its length.

The web 2 and handle 3 may have a length of 600 mm to 1500 mm, preferably about 1200 mm and the operative width of the web is 70 to 100 mm, preferably about 90 mm. A longer tool may be provided but only up to about 1800 mm is practicable for most users although tools of up to 2000 mm or even longer may be practicable for some users. In the preferred embodiments, the web 2 is an extrusion formed of a rigid or semi rigid PVC and has a thickness of between 1.0 and 3.0 mm, preferably about 1.7 mm. This gives the web sufficient stiffness and flexibility to operate efficiently.

The handle 3 is a hollow extrusion formed of aluminium and is substantially rigid. The handle has a generally rectangular profile comprising a first side 4 which is generally co-planar with the web, a second side 5, generally perpendicular to the web, a third side 6 parallel to the first side and a fourth side 7 parallel to the second side. The second side 5 is formed in an S profile providing a curved recess 8 extending along the handle and adapted to receive the fingertips of the user. The ergonomic design of the handle allows it to be comfortably gripped by the user at all times and especially when skimming overhead.

Figure 3:
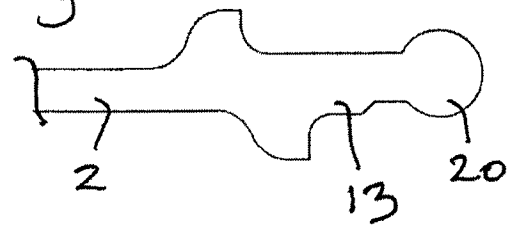
FIGS. 3 and 4 show details of portions of the skimming tool.
Figure 2:
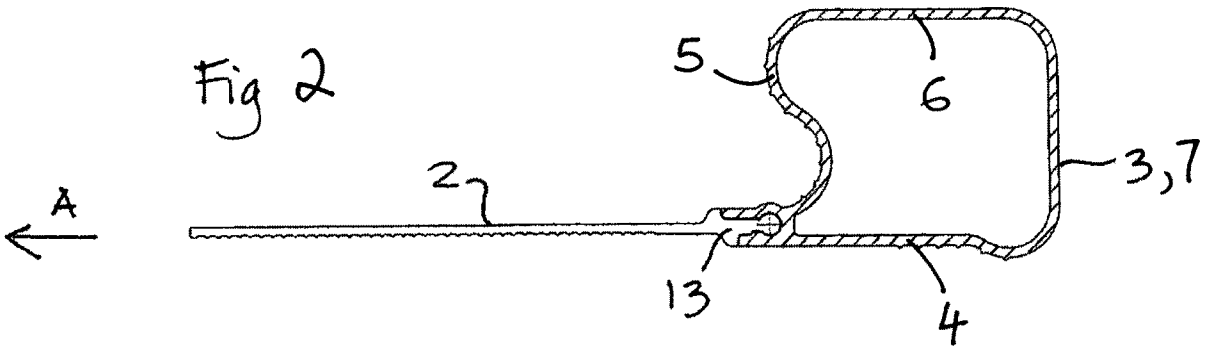
FIG. 2 shows an end view of the skimming tool.
Figure 4:
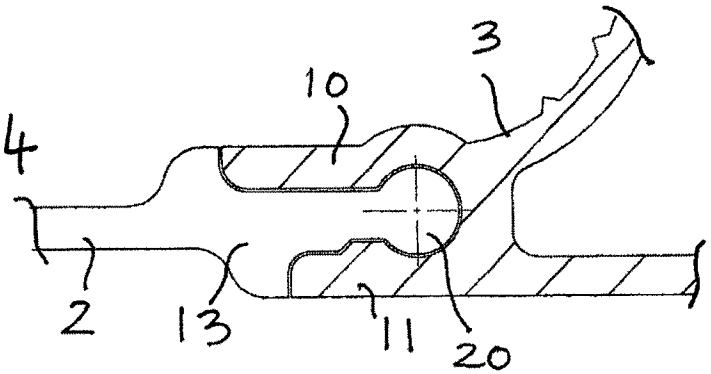

The handle 3 is provided with a bifurcated flange 9 at the junction between the first and second sides 4, 5 of the handle and extending generally in the plane of the web 2. The limbs 10 and 11 of the flange define a recess 12 in the form of a channel which extends along the length of the handle. The recess receives and holds the edge portion 13 of the web. Shoulders 14, 15 are formed on the web to abut the ends of the limbs 10 and 11. FIGS. 2 to 4 show a detailed cross-section through part of the handle and web. The edge portion 13 of the web is received and held in the recess in a slack fit having a nominal clearance all round the edge portion 13. The edge portion 13 has an enlarged section 20 running therealong which is held in a complimentary enlarged section 21 of the recess. The enlarged sections of the web and the recess are in the form of a ball and socket when viewed in cross-section. The shapes and dimensions of the web and recess, and in particular, the loose or slack fit, permit sliding movement of the edge portion 13 of the web along the length of the recess but prevent movement of the web out of the recess in the direction perpendicular to the length of the recess indicated by arrow A in FIG. 2. In this embodiment, the direction A lies in the plane of the web. The web is fitted to the handle by sliding the edge portion 13 of the web into and along the recess 12 on the handle.

The loose or slack fit of the edge of the web in the handle serves various functions. Firstly, it allows the web to expand differentially to the linear expansion of the handle. This is especially important where the handle and web are made of different materials since without this facility the web might expand more than the handle under ambient conditions. If the web is held rigidly in the handle, it may tend to kink or buckle along its length making it difficult or impossible to use correctly. Secondly, this arrangement enables simple replacement of a worn or damaged web into a handle. Other web profiles of rigid or semi-rigid design may be introduced for other different tasks to be performed.

Figure 5:
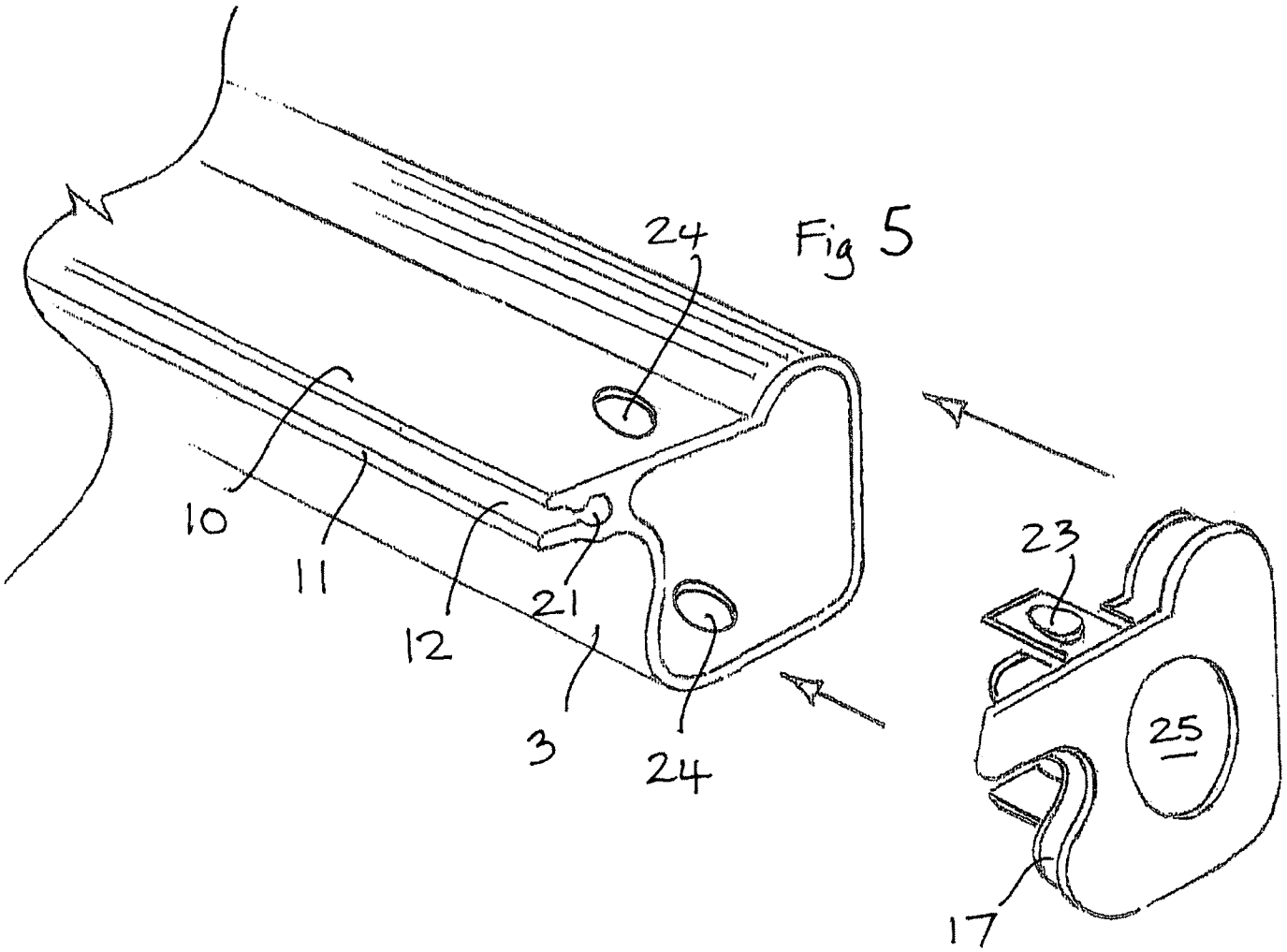
FIG. 5 shows an end portion of the handle of the skimming tool.

FIG. 5 shows an end portion of the handle with an end cap 17 which is a push fit into the open end of a hollow extruded handle and is retained by catches 23 snapping into apertures 24. The end cap may have an opening 25 which permits drainage of water from within the hollow handle. A portion of the end cap overlies the open end of the recess 12 to retain the web in place. An end cap will be provided at each end of the handle.

Figure 6:
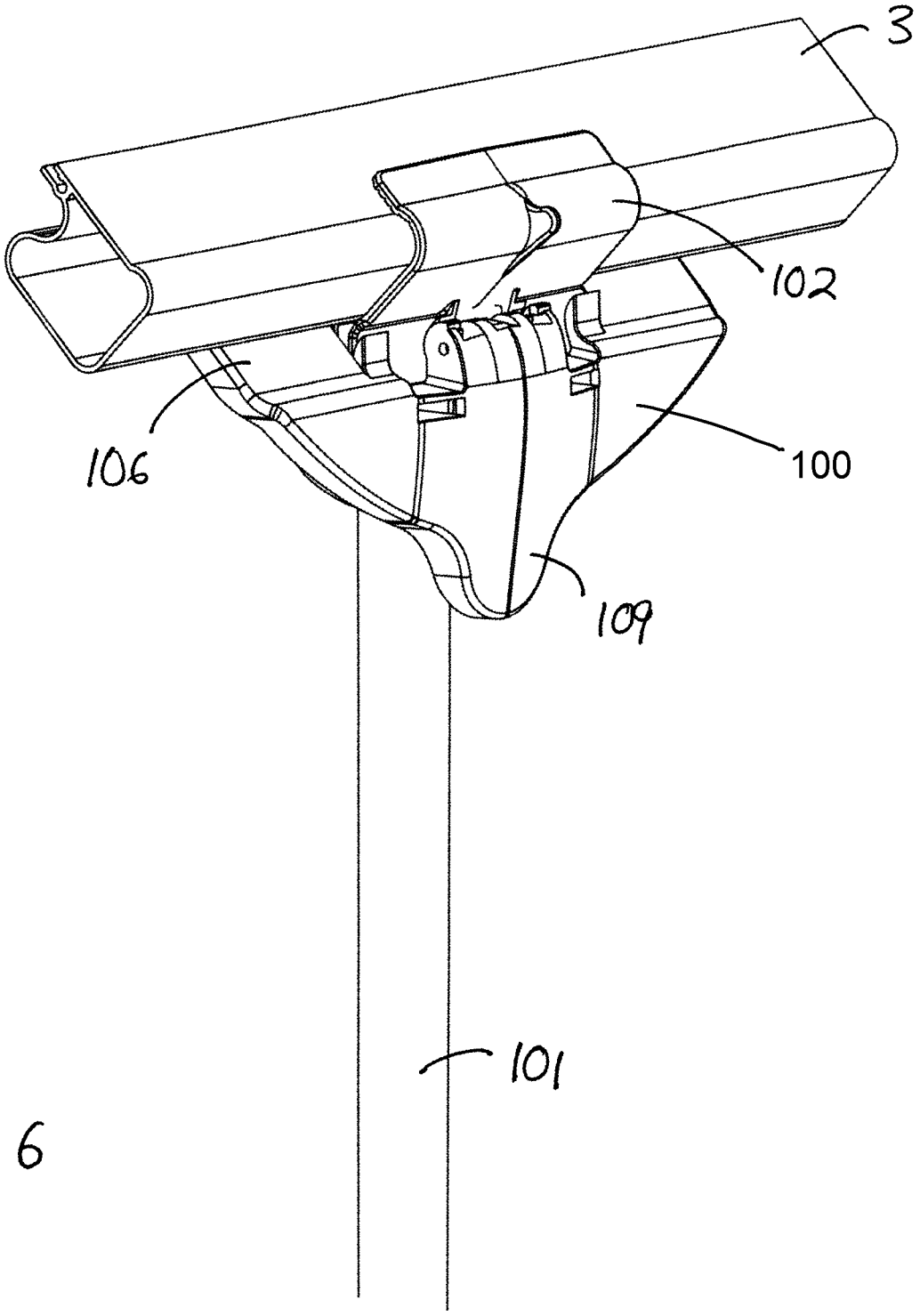
FIG. 6 shows a perspective view of a pole attachment in a clamped position attached to the handle of the skimming tool.

The lower surface of the web, which is the operative surface which engages the plaster being smoothed, is formed with a plurality of parallel grooves 18 extending along the length thereof and defining parallel ridges 16 therebetween. The ridges 16 and the flat grooves 18 therebetween are best seen in FIG. 6. This ridged surface helps to hold onto the plaster/material and distribute it evenly across peaks and troughs in the uneven substrate surface, thus facilitating an improved flatter finish. In addition the ridges also hold the surplus plaster on the tool during the operation preventing mess and spillage. The series of ridges along the surface strengthen the web but allow a slender profile and flexibility.

Consideration is now given to the pole attachment:

With reference to FIGS. 6 to 10, there is shown an exemplary pole attachment 100. The pole attachment allows for attachment of a pole 101 to the skimming tool 1 such that the tool may be used on hard to reach surfaces. The pole attachment, in general, comprises a pair of jaws 102, 103 for gripping the skimming tool and a clamping mechanism 105 for applying a clamping force to the jaws for locking the pole attachment to the skimming tool. The clamping mechanism comprises a pair of wings 106, which extend out beyond opposed transverse edges of the jaws in a width direction of the jaws. The wings provide lateral support to the skimming tool outside the jaws of the clamp and thereby provide increased stability during use of the skimming tool with the pole attachment.

Figure 8:
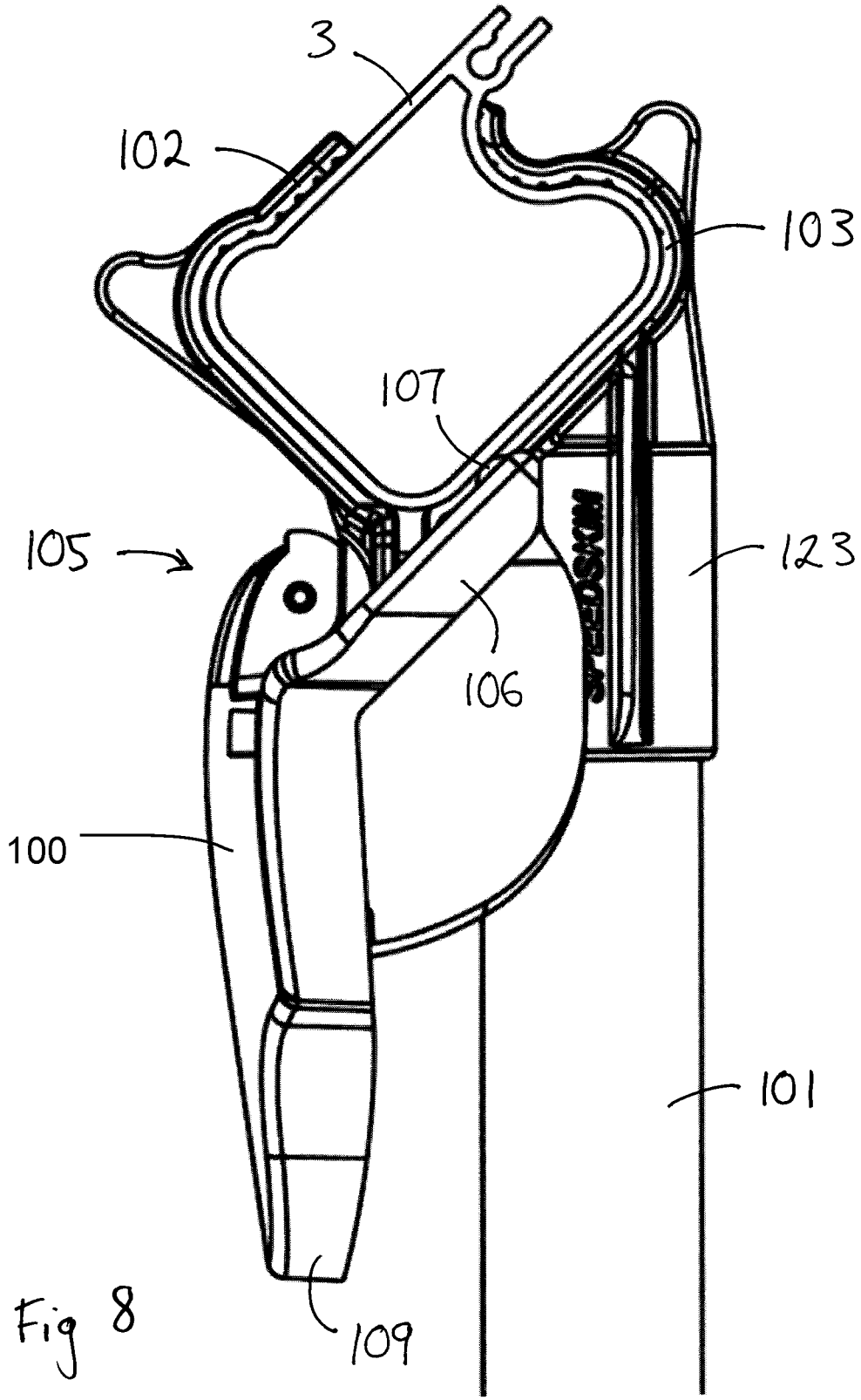
FIG. 8 shows an end view of the pole attachment in the clamped position attached to the handle of the skimming tool.

The wings each comprise an engagement surface that is substantially aligned with a clamping surface of one of the jaws when the clamp is in a clamped position, as best seen in FIG. 8. By such alignment, the engagement surfaces of the wings may engage and thereby support the skimming tool laterally of the clamp during use. The wings may take numerous forms to permit such engagement. In the present arrangement, as shown, the wings of the present arrangement lie substantially parallel to a clamping surface of one of the jaws in a clamped position. The engagement surfaces are formed by protrusions 107 on the wings. The protrusions are preferably integrally formed with the wings but need not be. They may be resilient or otherwise arranged to grip the surface of the skimming tool. In alternative arrangements, the protrusions may be omitted with a face 108 of the wing, which could be substantially planar as shown, or otherwise formed to generally conform to the profile of the skimming tool, providing the engagement surface. Moreover, it should be appreciated that when protrusions are provided there may be more or less protrusions than shown. There could be a single protrusion per wing.

There is no particular limitation on the width of the wings. However, in the preferred embodiment, the wings are each preferably around 50% of the width of the jaws, such that the wings together provide lateral support across a length of the tool that is substantially equal to the width dimension of the jaws. In alternative arrangements, the wings could be longer or shorter.

The clamping mechanism comprises a pivotally mounted lever 109, which forms the wings. The lever is preferably hingedly mounted as shown, however, various alternative pivoting mechanisms may be implemented, as will be appreciated by those skilled in the art. The lever comprises a pair of cams 110 for applying a clamping force to the jaws. The cams are preferably unitarily formed with the lever although may be separately formed and attached to the lever.

In the present arrangement, the lever and wings are unitarily formed by moulding or otherwise. It should be appreciated, however, that in alternative arrangements the lever and wings could be of multi-part construction.

The clamping mechanism need not comprise a cam. Various alternative mechanisms that are suitable for pushing/pulling/urging the jaws towards one another such that they apply a clamping force will be readily appreciated by those skilled in the art, including, for example, arrangements with pivoting lever arms. The cam arrangement is, however, preferred.

In the present arrangement, as may be seen, one of the jaws 103 comprises a knuckle 112 of the hinge, which passes through an aperture 113 in the other jaw, the other jaw 102 comprising a cam surface for engaging with the cams.

Figure 9:
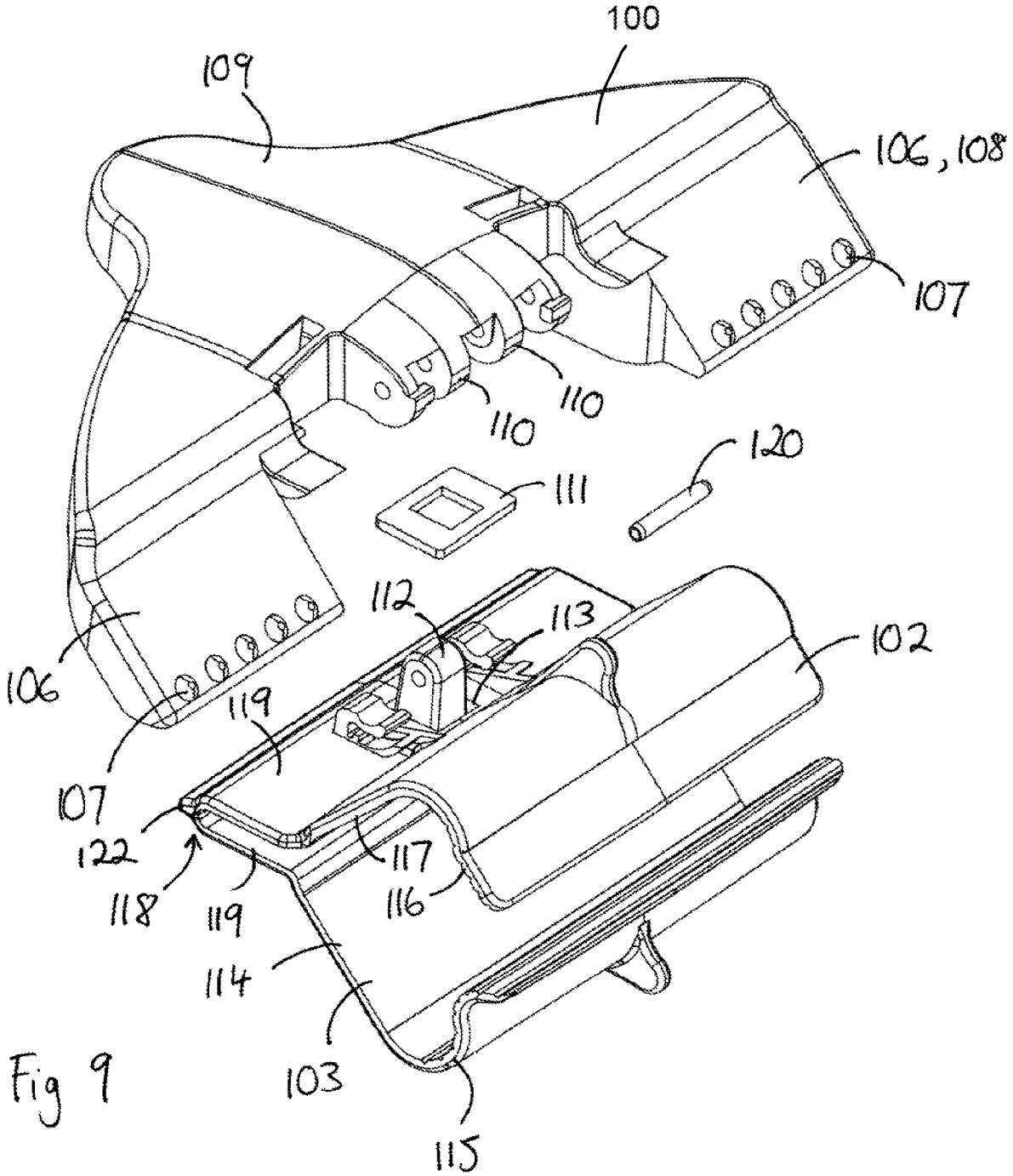
FIG. 9 shows an exploded perspective view of the pole attachment.
Figure 10:
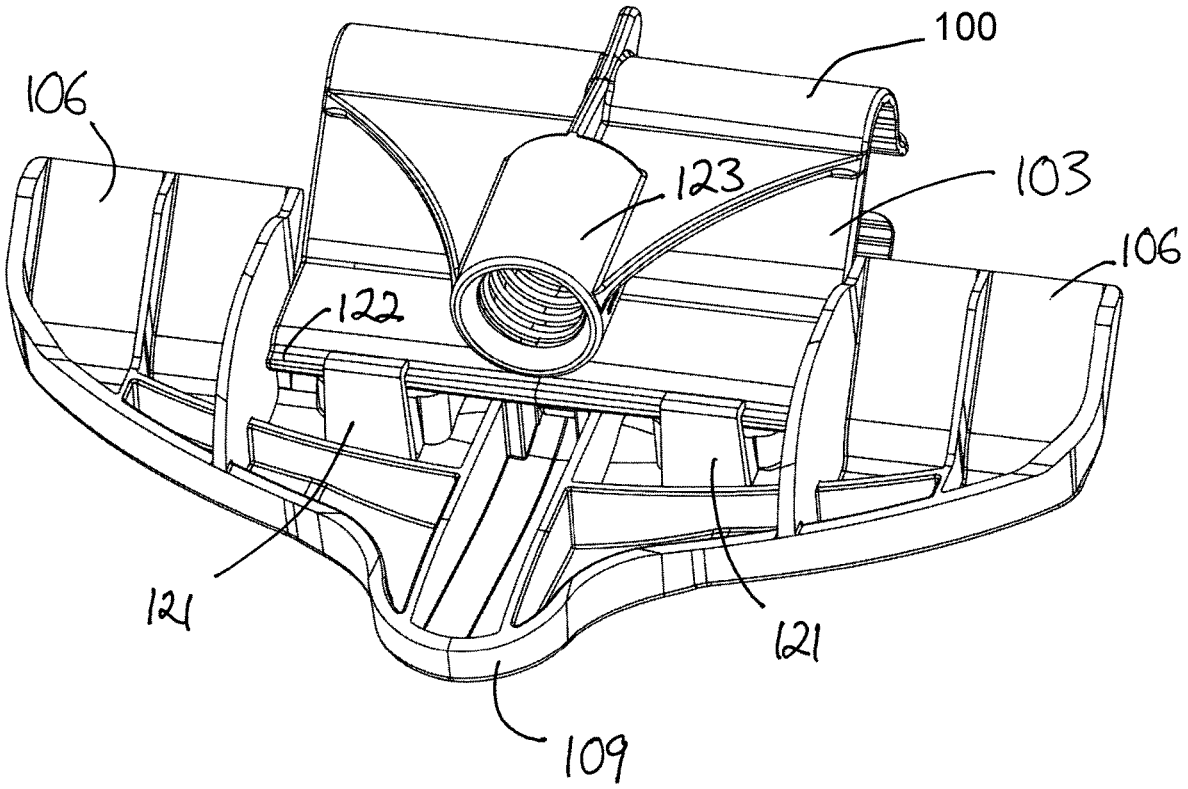
FIG. 10 shows a rear perspective view of the pole attachment in the clamped position.

The jaws are preferably inherently flexible and unitarily formed by moulding or otherwise, although could be separately formed to one another and either inherently flexible or joined by suitable means to allow for required relative movement therebetween. The jaws combine to define an opening, as best seen in FIGS. 8 and 9, which has a generally rectangular profile comprising first and second side surfaces 114, 115 that are substantially perpendicular to one another, a third side surface 116 substantially parallel to the first side surface and a fourth side surface 117 substantially parallel to the second side surfaces. The second side surface 115 has a substantially S-shaped profile for conforming to the curved recess 8 on the skimming tool handle. Accordingly, the profile of the opening conforms closely to the outer profile of the skimming tool, as defined above and best seen in FIG. 8. As discussed, however, in alternative arrangements, for attachment to differently profiled tools, the profile of the opening may be varied appropriately.

Figure 7:
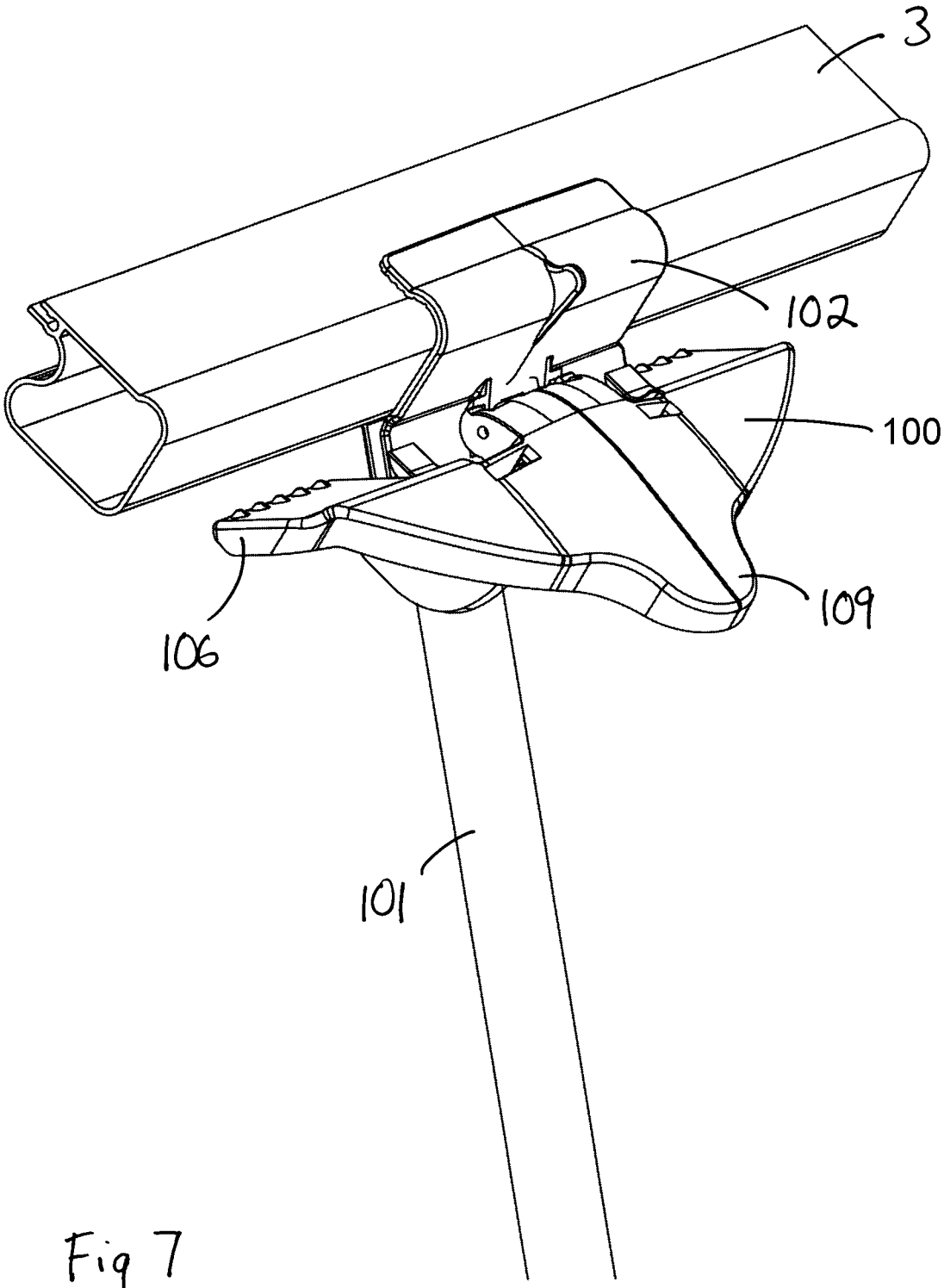
FIG. 7 shows a perspective view of the pole attachment in an open position on the handle of the skimming tool.

In use the pole attachment is slid onto a first end of the skimming tool with the clamp open (as seen in FIG. 7). The pole attachment is then slid along the skimming tool to a longitudinally central region of the skimming tool at which point the clamp is closed (as seen in FIG. 6) to lock the pole attachment in place.

A first of the jaws comprises the first and second side surfaces 114, 115 and the second jaw comprises the third and fourth side surfaces 116, 117. Rearwards of the opening formed by the first to fourth side surfaces, and proximal a joint portion 118 between the two jaws, the jaws comprise substantially planar portions 119 that extend parallel to one another, spaced from one another, and meet at a rearmost part of the jaws so as to define the joint portion. The knuckle 112 of the hinge projects from the planar portion 119 of the second jaw 103, substantially perpendicular thereto, and extends through the aperture 113 in the opposed planar portion 119 of the first jaw 102. The lever 109 comprises a pair of hinge knuckles 110 that each define a cam surface. A suitable hinge pin 120 is received by all of the knuckles. It should be appreciated that whilst the hinge of the present arrangement comprises a single knuckle on the jaws and a pair of knuckles on the lever, various other arrangements are possible, including arrangements with additional knuckles or an arrangement with two knuckles on the jaws and a single knuckle on the lever. With rotation of the lever, the cams apply a force to the planar portion of the second jaw, which force presses the first jaw towards the second jaw. The cam may act directly on an outer surface of the planar portion of the first jaw or there may be a cam plate 111 provided, as shown.

It is possible that an over centre cam is used such that a self-locking arrangement is provided. However, in the present arrangement a catch arrangement is provided for locking the clamp in the closed position. The catch arrangement comprises a pair of spaced resilient catches 121 that are formed on the lever and engage a ridge provided on a rear point of the joint portion of the jaws. Numerous alternative catch arrangements will be possible, as will be readily appreciated by those skilled in the art, including arrangements with more or less catches.

A pole attachment member 123 is provided on the second jaw 103. In the present embodiment as is preferred, the pole attachment member comprises a threaded opening, provided in a boss, which allows for screw fitting to a pole (not shown). Any alternative suitable pole attachment means may, however, be implemented. The pole attachment member is preferably unitarily formed with the jaws. The structure is such that the pole attachment member provides structural rigidity to the second jaw. Any suitable form of extension pole may be removably attached to the pole attachment via the pole attachment member 123.

In the preferred arrangement, as discussed in detail above, the pole attachment is primarily formed from two components, rendering it cost effective to manufacture.

The invention claimed is:

1. A pole attachment for a skimming tool, comprising a clamp, which comprises a pair of jaws for gripping the skimming tool and a clamping mechanism for applying a clamping force to the jaws, wherein the clamping mechanism comprises a pivotally mounted lever, which forms a pair of wings, wherein the lever comprises a cam for applying the clamping force to the jaws, and wherein the pair of wings extend out beyond opposed transverse edges of the jaws in a width direction of the jaws.

2. A pole attachment as claimed in claim 1, wherein the wings each comprise an engagement surface that is substantially aligned with a clamping surface of one of the jaws when the clamp is in a clamped position.

3. A pole attachment as claimed in claim 2, wherein the engagement surface is formed by one or more protrusions on the wing.

4. A pole attachment as claimed in claim 1, wherein the wings lie substantially parallel to a clamping surface of one of the jaws in a clamped position.

5. A pole attachment as claimed in claim 1, wherein the lever is hinged.

6. A pole attachment as claimed in claim 1, wherein one of the jaws comprises a knuckle of the hinge, which passes through an aperture in the other jaw, the other jaw comprising a cam surface for engaging with the cam.

7. A pole attachment as claimed in claim 1, which comprises a catch for locking the clamp in a clamped position.

8. A pole attachment as claimed in claim 1, wherein the jaws combine to define an opening having a generally rectangular profile comprising first and second side surfaces that are substantially perpendicular to one another, a third side surface substantially parallel to the first side surface and a fourth side surface substantially parallel to the second side surfaces, wherein the second side surface has a substantially S-shaped profile.

9. A pole attachment as claimed in claim 8, wherein one of the jaws comprises the first and fourth side surfaces and the other jaw comprises the second and third side surfaces.

10. A pole attachment as claimed in claim 1, wherein the jaws are unitarily formed.

* * * * *